US005865125A

United States Patent [19]

Alexander et al.

[11] Patent Number: 5,865,125

[45] Date of Patent: Feb. 2, 1999

[54] COMPUTER WORK STATION

[75] Inventors: Brian D. T. Alexander, Fennville; Steven J. Beukema, Grand Rapids, both of Mich.

[73] Assignee: Haworth, Inc., Holland, Mich.

[21] Appl. No.: 870,789

[22] Filed: Jun. 6, 1997

[51] Int. Cl.[6] ..... A47B 83/00

[52] U.S. Cl. ..... 108/50.011; 108/32; 312/196; 312/233; 312/239

[58] Field of Search ..... 108/32, 182, 27; 11/50.01, 459; 312/239, 196, 140.4, 223.3, 233; 248/441.1; D6/420, 460

[56] References Cited

U.S. PATENT DOCUMENTS

| | | | |
|---|---|---|---|
| D. 118,484 | 1/1940 | Salomon | D6/420 |
| D. 321,447 | 11/1991 | Newhouse . | |
| 581,127 | 4/1897 | McCorkle . | |
| 1,528,855 | 3/1925 | Smith . | |
| 1,818,606 | 4/1931 | Burks | 312/239 |
| 1,911,959 | 5/1933 | Kern et al. . | |
| 2,090,176 | 8/1937 | Besancon . | |
| 2,153,422 | 4/1939 | Kroman . | |
| 2,520,490 | 8/1950 | Boward . | |
| 2,947,998 | 8/1960 | Murphy | 108/32 |
| 4,605,988 | 8/1986 | Nienhuis et al. . | |
| 4,852,500 | 8/1989 | Ryburg et al. | 108/50.01 X |
| 4,894,600 | 1/1990 | Kearney | 108/144.11 X |
| 4,914,873 | 4/1990 | Newhouse . | |
| 4,938,366 | 7/1990 | Carroll . | |
| 4,948,205 | 8/1990 | Kelley | 312/196 |
| 5,009,335 | 4/1991 | Jonker . | |
| 5,018,628 | 5/1991 | Schenck et al. | 108/27 X |
| 5,024,167 | 6/1991 | Hayward . | |
| 5,120,117 | 6/1992 | Williams . | |
| 5,289,926 | 3/1994 | Lewis et al. . | |
| 5,317,977 | 6/1994 | Omessi . | |
| 5,481,987 | 1/1996 | Maitland | 312/196 X |
| 5,568,773 | 10/1996 | Hung | 312/196 X |
| 5,609,112 | 3/1997 | Meyer et al. . | |

FOREIGN PATENT DOCUMENTS

| | | | |
|---|---|---|---|
| 481159 | 4/1992 | European Pat. Off. | 312/223.3 |
| 531794 | 3/1993 | European Pat. Off. | 312/223.3 |
| 404005910 | 1/1992 | Japan | 312/196 |

OTHER PUBLICATIONS

Levenger Holiday 1994 Brochure, p. 40, "Editor's Desk", received in the PTO Sep. 30, 1994.

Two Haworth, Inc.'s drawings designated as Drawing A and Drawing B which respectively correspond to Figures 1 and 7 of copending application 08/890,914.

*Primary Examiner*—Peter M. Cuomo
*Assistant Examiner*—Hanh V. Tran
*Attorney, Agent, or Firm*—Flynn, Thiel, Boutell & Tanis, P.C.

[57] ABSTRACT

A work station includes a lower work surface and a pair of tiered article support sections located above the work surface. The work surface defines a generally planar area along an inner edge thereof, and an inclined storage area which angles upwardly and outwardly away from the planar area for the storage of documents thereon. The tiered article support sections include a lower tier which extends vertically and includes an erasable marker board surface. Each lower tier supports an upper tier which defines an upper shelf or ledge for the storage of documents. A worker using this computer work station is able to readily store, view and access documents located either on the work surface or the article support sections to facilitate organization of work-in-progress.

15 Claims, 7 Drawing Sheets

COMPUTER WORK STATION

FIELD OF THE INVENTION

This invention relates to a work station for use in an office-type environment and more particularly, to a work station having tiered article support sections located above a work surface which provides an increased surface display area, both vertically and horizontally, for displaying and accessing documents as they are being used.

BACKGROUND OF THE INVENTION

Most offices provide conventional work surfaces such as tables and desks for supporting papers and the like. However, for jobs or projects which involve a large volume of paper, conventional work surfaces typically have a limited amount of table or desk top space. This limited space can make it more difficult to manage or control a large amount of papers or documents as they are being used. More specifically, the worker typically has a limited amount of space in which to spread out and display the documents. Further, even when the documents are spread out on the work surface, those documents that are stored in the areas of the work surface located farthest away from the worker typically are more difficult to access and view.

It is an object of the invention, therefore, to provide a work station which overcomes many of the difficulties associated with displaying and accessing documents on conventional work surfaces.

This invention relates to a work station which provides an increased surface display area which facilitates the display and organization of the documents being used by a worker, i.e. the worker's work-in-progress. In particular, the inventive work station includes a lower work surface and a pair of tiered article support sections located above the work surface which more effectively displays work-in-progress and increases the display area on which the documents can be stored.

More particularly, the work surface is horizontally enlarged and is U-shaped so as to provide a work surface area which partially wraps around the user to facilitate access to documents being stored thereon. The work surface includes a generally flat or horizontal work area which is defined by the area along an inner edge of the work surface that is closest to the user. This inner work area provides the primary area, for example, for writing or for the use of a computer keyboard.

The work surface also includes an inclined storage area which angles upwardly and outwardly away from the work area and the user located adjacent thereto. The inclined storage area is provided for the storage of documents, for example, that are used more frequently wherein the inclination of the storage surface makes it easier to review and locate the documents.

The tiered article support sections further increase the amount of display area in the work station. The article support sections are spaced upwardly above the lower work surface and preferably are located to the left and right sides of the worker. Each section includes a lower tier which extends horizontally along an outer edge of the work surface and vertically at an inclined angle. The lower tier preferably includes a functional surface, such as an erasable marker board surface to allow a worker to take notes and draw sketches.

Each of the left and right article support sections further includes an upper tier which extends vertically upwardly from the lower tier and is horizontally offset so as to define an upper shelf or ledge on which documents can be readily stored. The documents are stored at such an angle to allow a user to readily see, identify and access the documents. Further, the upper tier also is formed of a marker board material to define an additional functional surface on which a user can readily write and take notes. The markable surfaces of the upper and lower tiers alternatively can be formed of other functional materials, such as a tackable material.

The work station further includes a height adjustable computer monitor which is located in a region between the left and right article support sections, preferably in front of a user. The computer monitor is spaced above the inclined area of the work surface to allow papers to be stored directly underneath the computer monitor.

With this work station, a worker seated thereon is partially surrounded by the horizontal work surface while the article support sections extend upwardly above the left and right sides of the work surface. The worker can thereby work in this work station while being able to readily store, see and access documents located either on the work surface or the article support sections, and also can readily use the markable surfaces thereof. The work station thereby makes it easier for a worker to organize his or her work-in-progress.

Other objects and purposes of the invention, and variations thereof, will be apparent upon reading the following specification and inspecting the accompanying drawings.

Figure 1:
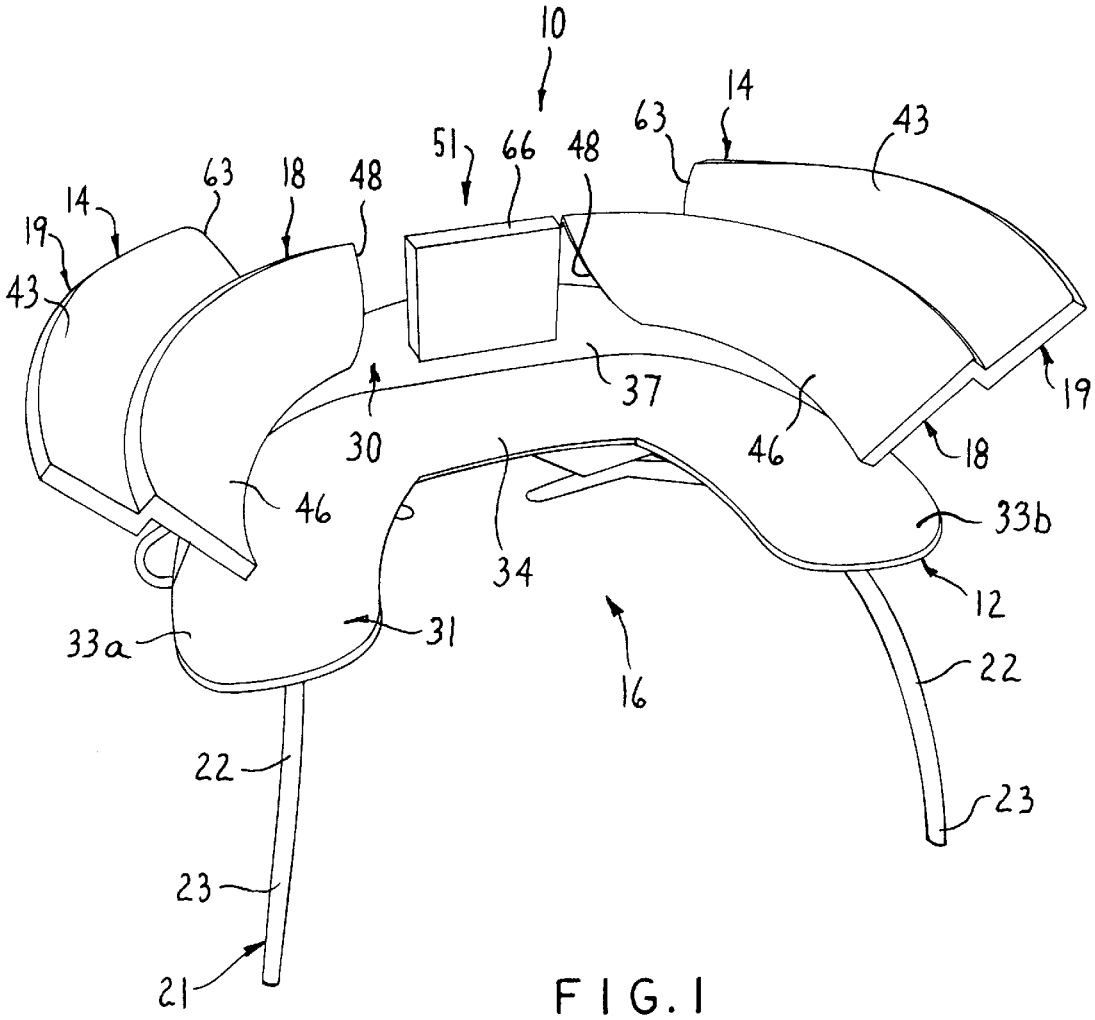
FIG. 1 is a rear perspective view of a work station according to the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
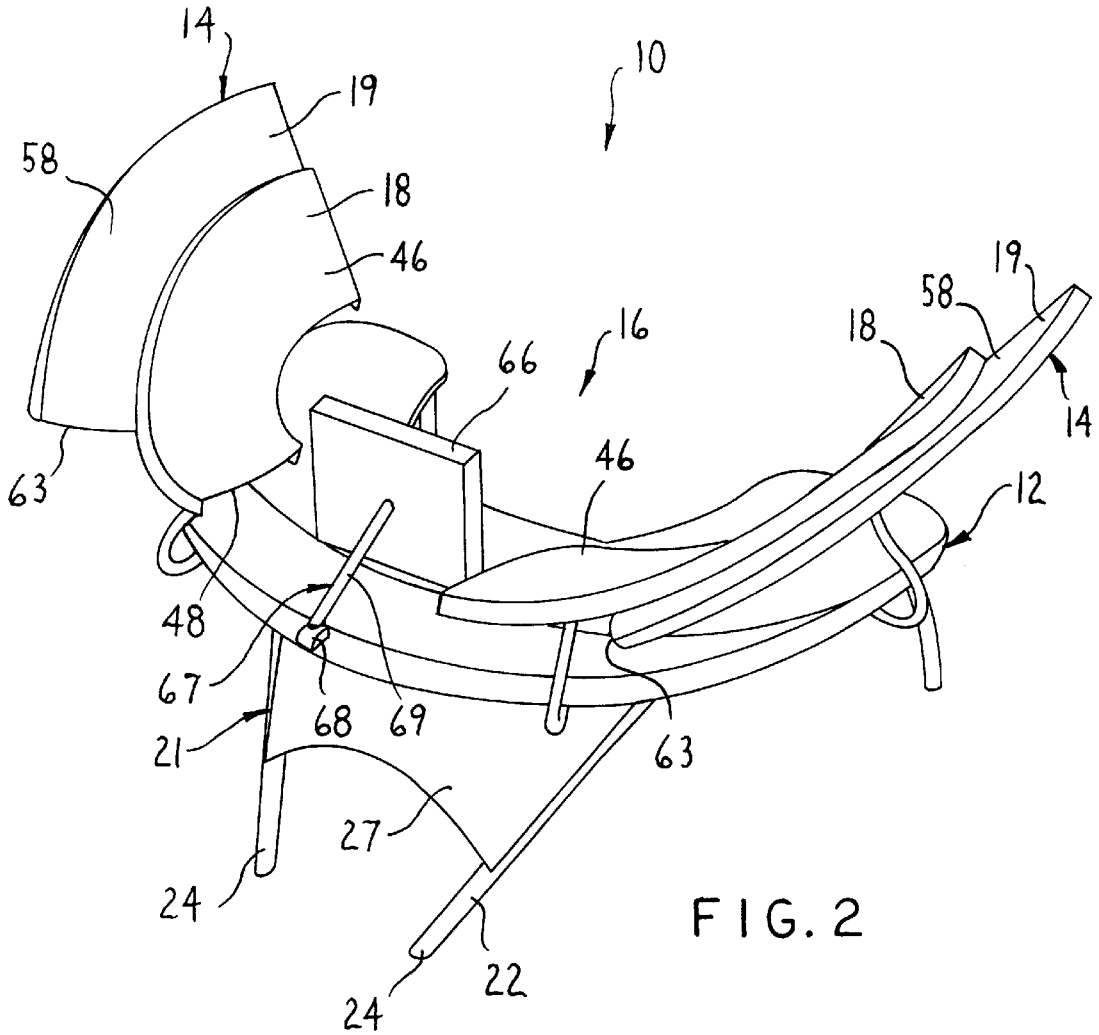
FIG. 2 is a front perspective view of the work station.
Figure 3:
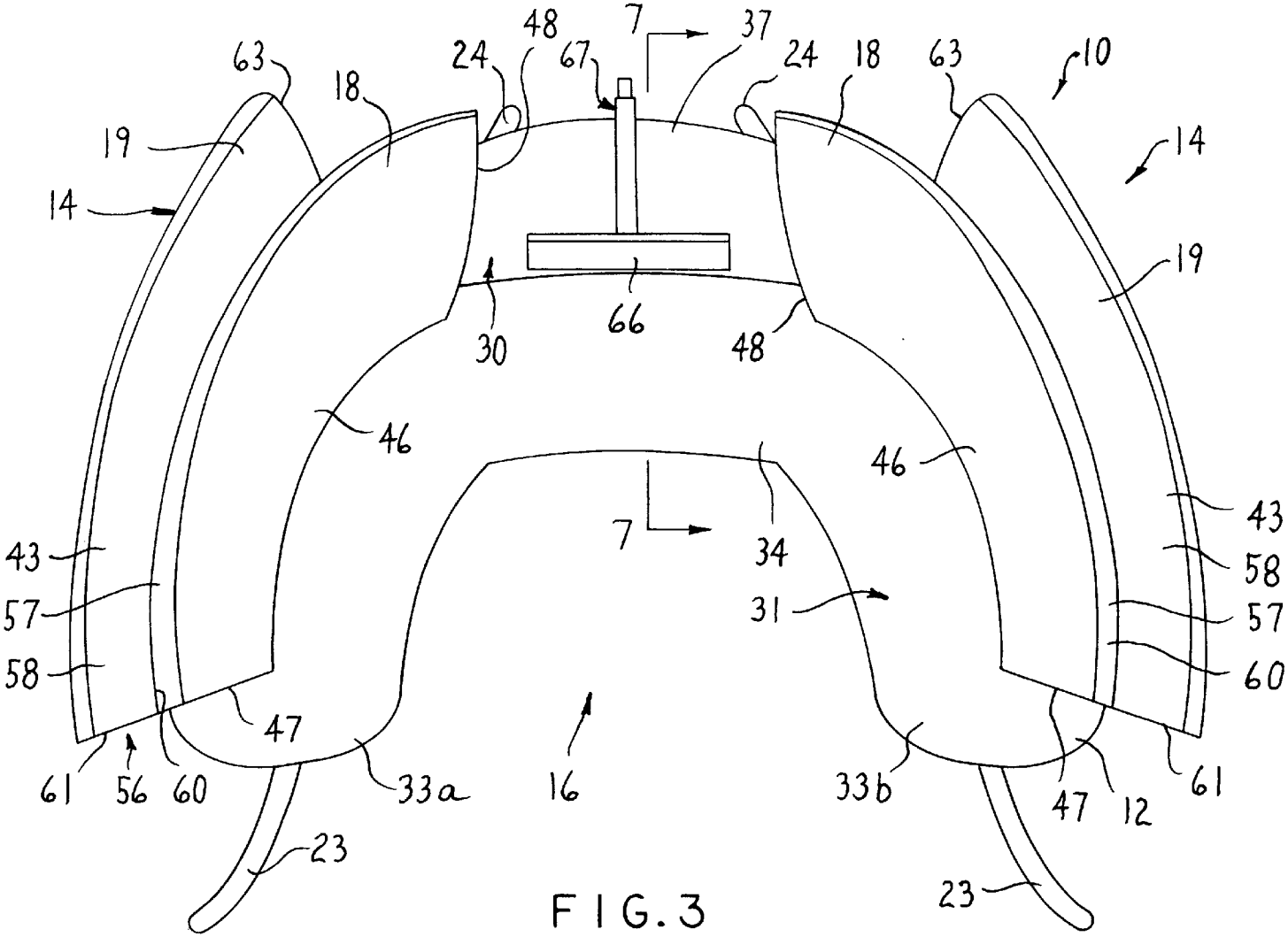
FIG. 3 is a top plan view of the work station.

Referring to FIGS. 1–3, the invention is a computer work station 10 that provides an increased storage area which more readily allows a user to store, view and access documents thereon. The work station 10 includes a U-shaped horizontally enlarged work surface 12 and a pair of tiered article support sections 14 disposed on the left and right sides of the work station 10.

Generally, the work surface 12 has a U-shape to define a centrally located seating area 16 and partially surrounds a worker located in the seating area 16. The tiered article support sections 14 are spaced upwardly above the work surface 12 and are located on the left and right sides of the seating area 16. Each article support section 14 includes a horizontally elongate lower tier 18 which is formed of a marker board material, and a horizontally elongate upper tier 19 which projects upwardly above the lower tier 18 and readily permits the storage of documents thereon. The work surface 12 provides the primary area in which the user's work-in-progress will be stored and organized, although the article support sections 14 provide additional storage space to facilitate the organization of documents.

Figure 4:
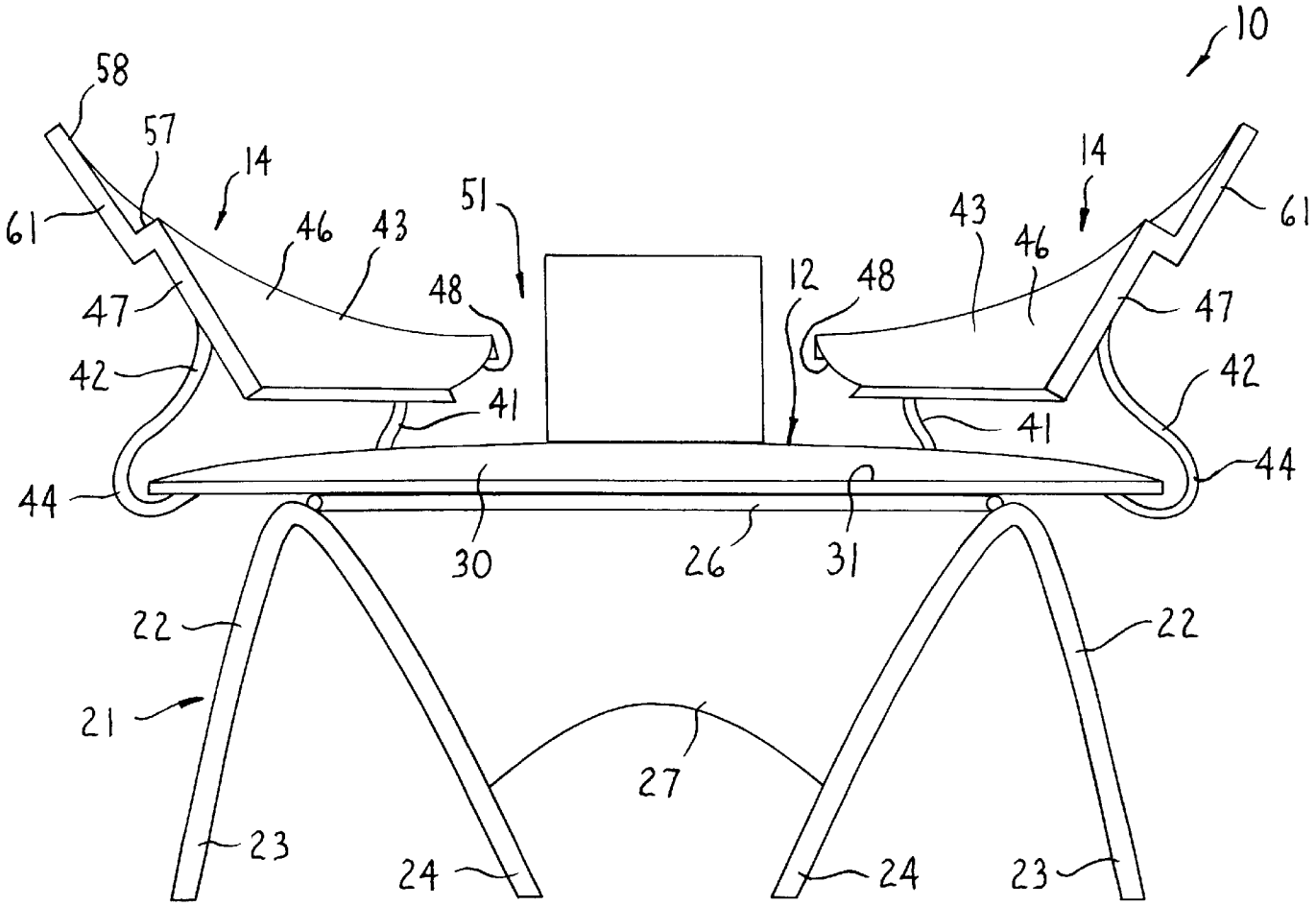
FIG. 4 is a rear elevational view of the work station.
Figure 5:
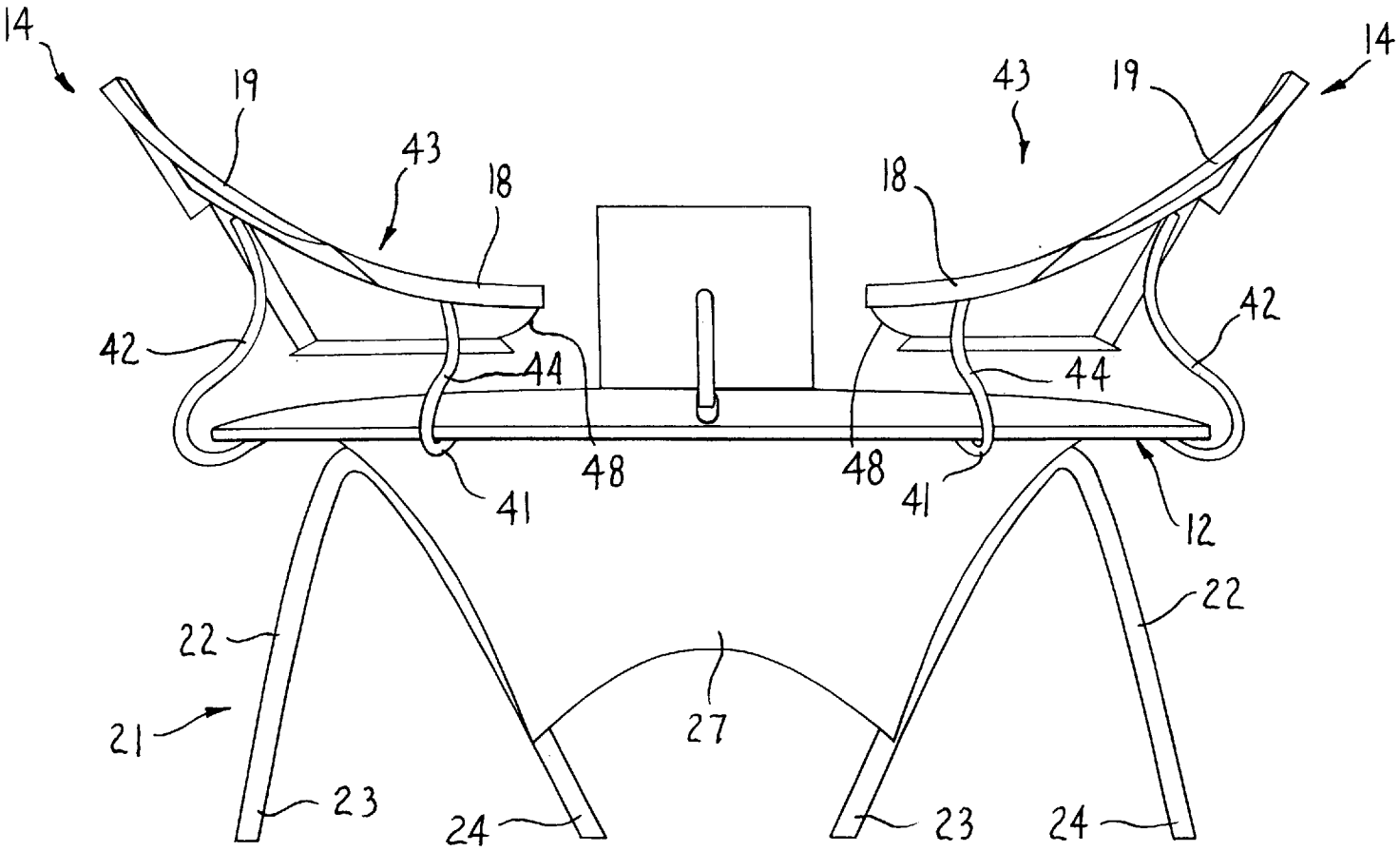
FIG. 5 is a front elevational view of the work station.
Figure 6:
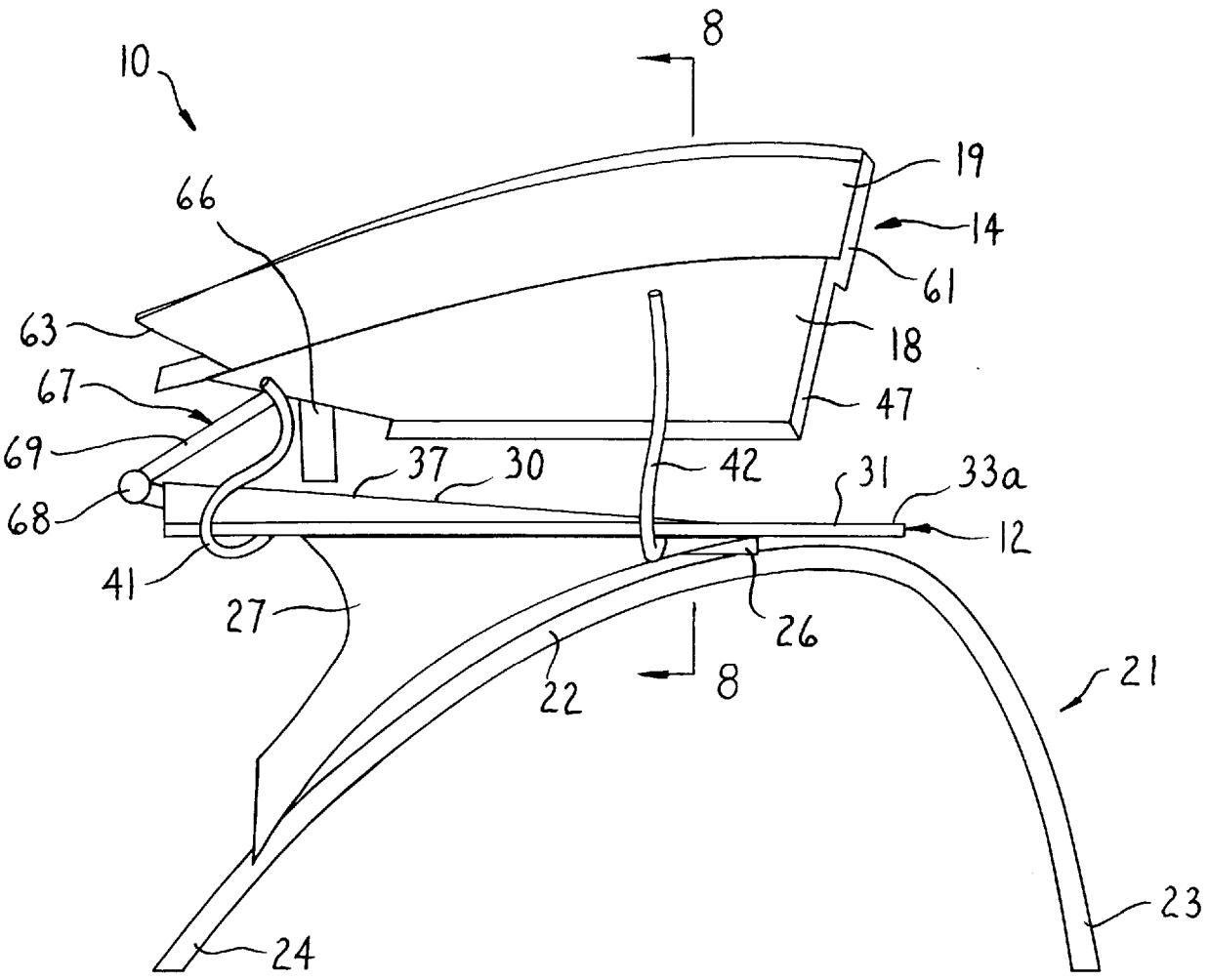
FIG. 6 is a left side elevational view of the work station.

More particularly, to support the work surface 12, the work station 10 includes a support frame 21 (FIGS. 4–6) which is supported on a floor. The support frame 21 includes left and right U-shaped leg members 22 which are laterally spaced apart to define the seating area 16 therebetween, and have a downward opening U-shape so as to each define a rear leg 23 and a front leg 24 which are joined integrally together. Preferably, the front legs 24 extend inwardly at an angle relative to the rear legs 23 so as to be located near the center of the work station 10.

Further, the support frame 21 includes a U-shaped upper frame member 26 which extends horizontally so as to support the horizontal work surface 12 thereon. In particular, the U-shaped upper frame member 26 has free ends which extend rearwardly and are secured to the uppermost sections of the U-shaped leg members 22 to rigidly join the leg members 22 together.

The front end of the upper frame member 26 is vertically supported by a front privacy panel 27 which is rigidly secured thereto. In particular, the privacy panel 27 has a rearward opening U-shape wherein the rear edges of the privacy panel 27 are fixed to the rear legs 23. The privacy panel 27 is formed of a rigid material so as to not only enclose and provide privacy to the area located below the work surface 12 but also rigidly support the upper frame member 26 on the U-shaped leg members 22.

The arrangement of the leg members 22, upper frame member 26 and the privacy panel 27 thereby effectively defines a rearward-opening U-shaped structure for supporting the work surface 12 thereon.

The work surface 12 is secured to the top of the support frame 21 such as by suitable fasteners or the like, and has a U-shape which opens rearwardly such that the work surface 12 and support frame 21 define the seating area 16. In particular, the work surface 12 and support frame 21 extend rearwardly on the left and right sides of the seating area 16 so as to partially surround the worker during use. This U-shape increases the area of the work surface 12 which is located directly adjacent to the worker.

The work surface 12 is horizontally enlarged and is formed of a generally flat inner work area 31 extending along an inner edge of the work surface 12, and an inclined outer storage area 30 extending along an outer edge thereof.

In particular, the work area 31 (FIGS. 1, 2 and 6) extends along the inner edge of the work surface 12 which is located directly adjacent to the worker and generally defines the boundary of the seating area 16. More particularly, the work area 31 extends forwardly along left and right end sections 33*a* and 33*b* of the work surface 12 as well as sidewardly along an intermediate work surface section 34. This U-shaped work area 31 is substantially flat so as to provide a relatively large planar area on which a user can, for example, write or support a computer keyboard (not illustrated). This relatively large work area 31 also allows a user to spread out documents which are being used at that time.

To reduce the amount of documents which are stored in the work area 31 immediately adjacent to the seating area 16, a front portion of the intermediate work surface section 34 is inclined upwardly to define the inclined storage area 30 which extends along the outer edge of the work surface 12. While most of the inclined storage area 30 extends sidewardly across the intermediate section 34, the storage area 30 also is generally U-shaped such that the rear ends thereof extend a limited distance along the left and right sections 33*a* and 33*b*. The storage area 30 is progressively thinner and narrower in the rearward direction such that the rear ends of the storage area 30 only extend along a small portion of the left and right work surface sections 33*a* and 33*b* near the outer edges thereof.

Figure 7:
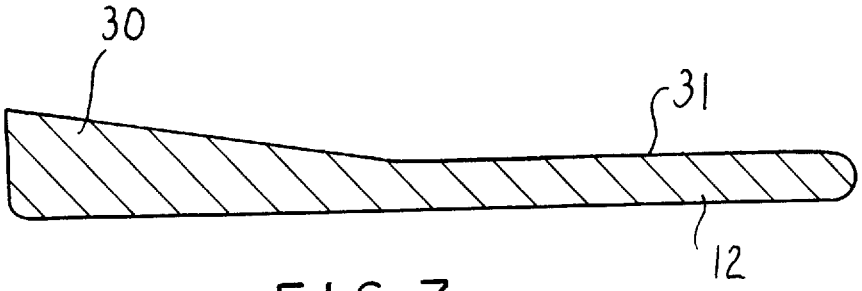
FIG. 7 is a side cross-sectional view as viewed in the direction of arrows 7—7 in FIG. 3.

The inclined storage area 30 (FIG. 7) is formed integral with the planar work area 31 such that the inclined area 30 slopes upwardly away from the boundary between the inclined area 30 and the work area 31. The inclined storage area 30 thereby defines an inclined surface 37 on which papers and documents may be stored at a small angle relative to the planar work area 31. This inclined angle of the papers and documents allows a worker to more readily view, locate and manipulate the documents.

To further increase the overall storage area provided in the work station 10, the tiered article support sections 14 are provided on the left and right sides of the seating area 16. The article support sections 14 are formed as mirror images of each other such that the following discussion relative to the structure and function of one of the article support sections 14 is equally applicable to the other of the article support sections 14.

Referring to FIGS. 3–6, each article support section 14 includes vertically elongate front and rear support posts 41 and 42, and a rigid article-supporting panel 43 supported thereon. The support posts 41 and 42 extend upwardly away from the work surface 12 so as to position the article-supporting panels 43 vertically above the work surface 12.

More particularly, each of the front and rear support posts 41 and 42 has a lower end rigidly supported on the bottom of the work surface 12 while the upper ends thereof support the rigid panel 43. At least a portion of the panel 43 preferably is located directly above and overlies the work surface 12.

Figure 8:
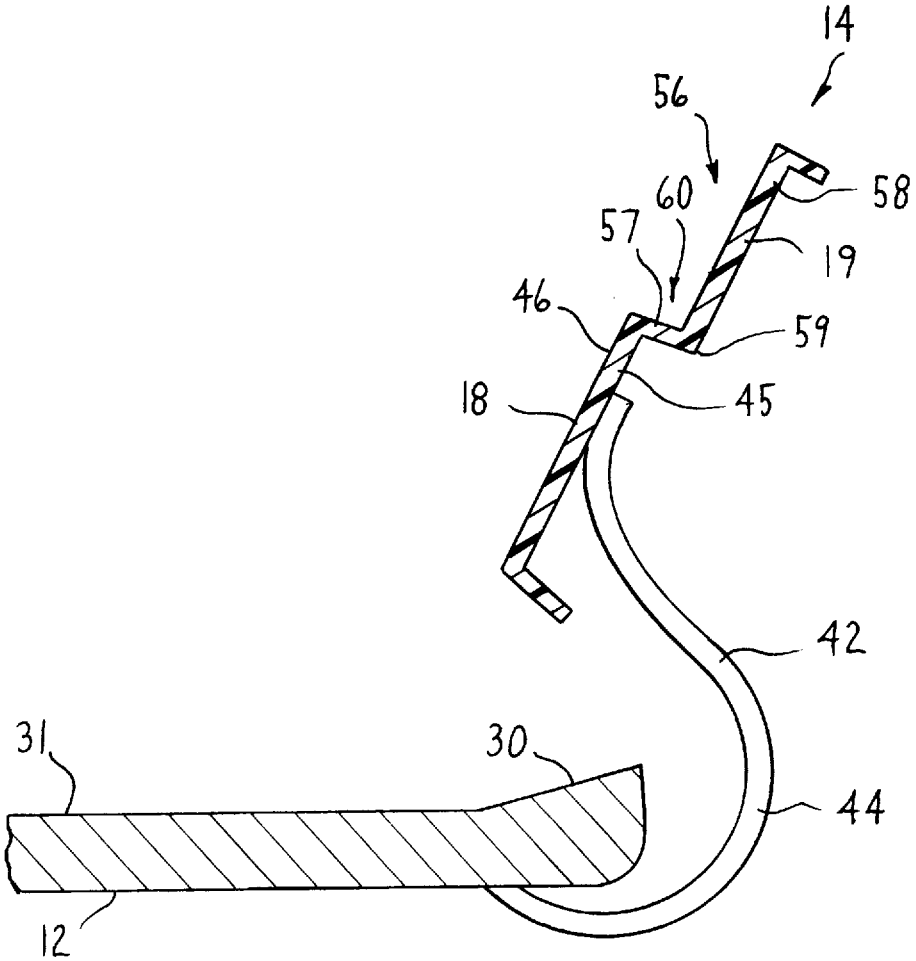
FIG. 8 is a cross-sectional view as viewed in the direction of arrows 8—8 in FIG. 6.

Preferably, an intermediate section 44 (FIGS. 4, 5 and 8) of the support posts 41 and 42 defined between the upper and lower ends thereof has an S-shape. In particular, the front and rear support posts 41 and 42 extend outwardly away from the outermost edges of the horizontal work surface 12 and thereafter curve inwardly so that the upper ends are disposed directly above the work surface 12. Thus, the front and rear support posts 41 and 42 do not encroach upon or interfere with the worker's use of the work surface 12 located directly adjacent thereto.

Referring to FIGS. 1–3 and 8, the article-supportive panel 43 is defined by the lower tier 18 and the upper tier 19. The lower tier 18 includes a planar upright wall 45 which projects upwardly and also is slightly sloped rearwardly so as to define an inclined front surface 46 thereof. Preferably, the front surface 46 is a markable fiberglass or resin material which can be written on by conventional markers or other writing instruments. The markable material also is erasable. Thus, the front surface 46 defines a surface upon which a worker can readily write or sketch. This markable front surface 46 is located near eye level relative to the user to permit ready reference to the markings and sketches thereon.

When viewed from above as seen in FIG. 3, the lower tier 18 has an arcuate shape curved along the longitudinal length thereof which arcuate shape generally conforms to the shape of the outer edge of the work surface 12. Preferably, the rear edges 47 of the lower tier 18 terminate near the rear edges of the work surface 12. The front edges 48 of the two lower tiers 18, however, curve inwardly toward each other as they extend in a forward direction but are laterally spaced apart to define an intermediate space 51 therebetween. The intermediate space is located above the inclined storage area 30 as will be discussed in detail hereinafter.

The upper tier 19 defines a generally L-shaped upper shelf 56 (FIG. 8) which is defined by a bottom wall 57 and an upright wall 58 which faces inwardly toward the seating area 16. Accordingly, the upper shelf 56 projects upwardly from the lower tier 18 and defines a storage area for the storage of documents and the like thereon.

More particularly, the bottom wall 57 of the upper shelf 56 is joined to the upper edge of the lower tier 18 but projects rearwardly therefrom. As a result, the upright wall 58 is offset horizontally outwardly relative to the front surface 46 of the lower tier 18 such that the panel 43 has a vertically stepped configuration. Further, referring to FIG. 8, the bottom wall 57 is outwardly declined.

The lower edge of the upright wall 58 is joined to the outer edge of the bottom wall 57 at a corner 59 thereof. The upright wall 58 projects upwardly from the corner 59 but is outwardly inclined relative to the bottom wall 57. Preferably, the height of the upright wall 58 as measured between the upper and lower edges thereof is significantly greater than the width of the bottom wall 57 as measured between the inner and outer edges thereof.

Accordingly, papers and documents can be seated on the bottom wall 57 in a generally upright position due to the inclined angle of the upright wall 58. Further, since the bottom wall 57 is at a declined angle, the corner 59 generally defines a horizontally extending channel 60 therealong which not only facilitates the storage of papers but also allows for the storage of markers or other writing utensils therein. The upper shelf 56 thereby extends horizontally such that the channel 60 extends along the upper edge of the lower tier 18.

In particular as seen in FIG. 3, a rear side edge 61 of the upper tier 19 defines a vertical extension of the rear side edge 47 of the lower tier 18. The upper tier 19, however, has a shorter horizontal length than the lower tier 18 such that a front side edge 63 of the upper tier 19 is spaced horizontally away from the front side edge 48 of the lower tier 18.

Preferably, the lower tier 18 and upper tier 19 are formed integrally one with the other wherein the panel 43 is formed as a one-piece unit. Thus, when viewed from the side (FIG. 6), the height of the panel 43 is greatest at the rear edge thereof but tapers downwardly toward the front end thereof.

Preferably, the panel 43 is formed of a suitable fiberglass, synthetic resin, plastic or other markable material such that both the lower tier 18 and the upper tier 19 can be written upon with markers. Alternatively, either or both of the front surfaces 46 and 61 can also be formed of another type of functional material, such as a tackable material which allows documents such as notes, sketches or drawings to be tacked thereon and supported on either the lower tier 18 and/or the upper tier 19.

Still further, while the upper tier 19 is formed as an upper shelf 56, the lower tier 18 also could be formed with an inwardly projecting bottom wall (not illustrated) along the lowermost edge thereof such that the lower tier 18 defines a lower shelf.

Since the work station 10 includes the intermediate space 51 formed between the left and right article support sections 14, the work station 10 can be specifically adapted for use as a computer work station. In particular, the work station 10 is provided with a computer monitor 66 which is mounted to the outer edge of the work surface 12.

Referring to FIGS. 2, 3, 5 and 6, the computer monitor 66 is supported on an adjustable arm 67. The adjustable arm 67 includes a lower pivot or swivel joint 68 which is rigidly supported on the outer edge of the work surface 12. A support arm 69 is pivotally supported to the pivot joint 68 so as to be vertically and sidewardly movable. The upper distal end of the support arm 69 supports the computer monitor 66 thereon, and the adjustable arm 67 preferably accommodates cabling therethrough so as to provide a video signal to the computer monitor 66. Further, the arm 69 can be telescopable to move the monitor 66 forwardly and rearwardly. Thus, the position of the computer monitor 66 can be adjusted vertically laterally and/or forwardly relative to the work surface 12.

Thus, in use, a worker typically sits in the seating area 16 and can readily work upon the planar work area 31 defined along the proximal inner edge of the work surface 12. This area typically is used for the documents which the user actively is using or which have the highest importance and which likely will be used in the near future. However, where the worker is done with a document at least temporarily, the worker can place the document upon the inclined storage area 30. The document is stored on this inclined area 30 out of the way of the worker although it can be readily identified and retrieved due to the inclined angle of the surface.

When, for example, a user is done with a document or only uses the document intermittently, the worker can store the document upon the upper shelf 56. The inclined angle and vertical height of the upper shelf 56 allows a user to spread the documents out along the length thereof and also allows the user to readily identify and access the documents where necessary.

Since many work station environments allow for the frequent interaction of teams of workers, the formation of both the upper and lower tiers 18 and 19 from a marker board material allows the workers to write or sketch upon the surfaces. In particular, the lower tier 18 typically is not covered by documents and thus provides a continuously accessible surface upon which the worker can take notes, draw and/or sketch. The lower tier 18 also defines an area upon which self-adhering papers or papers provided with adhesives or fasteners can be stored. The inventive work station 10 thereby provides an increased amount of storage area that can be readily adapted to the particular needs of a worker.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A work station comprising:

a support frame;

a horizontally enlarged work surface mounted to said support frame, said work surface having a U-shape, which defines an open rear seating area that is disposed between opposite side sections of said work surface, an inner edge section of said work surface being adjacent said seating area, an outer edge section of said work surface being outward of said inner edge section remote said seating area, said work surface comprising a substantially horizontal, planar work area which extends along said inner edge section of said work surface disposed adjacent to said seating area and an inclined planar area disposed outwardly of said work area, said inclined area extending along said outer edge section of said work surface, said inclined area being inclined at an obtuse angle relative to said work area and being adapted to store documents thereon inclined relative to said work area; and a tiered article support section which includes an upper frame supported adjacent to said work surface and an article support panel supported on said upper frame a vertically spaced distance above said outer edge section of said work surface, said article support panel being vertically enlarged and including a lower tier which projects vertically above said outer edge section and is outwardly inclined, and an upper tier which is supported on said lower tier and defines a shelf for supporting articles thereon, said shelf including a bottom wall which extends outwardly away from said lower tier and a back wall which extends upwardly from said bottom wall, said back wall being horizontally offset outwardly relative to said lower tier.

2. A work station according to claim 1, which includes first and second said article support sections which are disposed vertically above said outer edge section at respective side sections of said work surface.

3. A work station according to claim 2, wherein said first and second article support sections are horizontally elongate so as to extend generally along outer edges of said outer edge section on the opposite sides of said work surface, said first and second article support sections extending longitudinally toward adjacent end sections thereof which are disposed in laterally spaced relation relative to each other to define an intermediate space therebetween.

4. A work station according to claim 1, wherein said upper frame projects upwardly above said work surface, said upper and lower tiers being supported on said upper frame.

5. A work station according to claim 4, wherein said article support section includes a panel connected to said upper frame, said panel defining said upper and lower tiers which are formed integrally together as a one-piece unit.

6. A work station comprising:

a support frame;

a horizontally enlarged work surface mounted to said support frame, said work surface having a U-shape which defines an open rear seating area which is disposed between opposite side sections of said work surface, said work surface comprising a work area which extends along an inner edge section of said work surface disposed adjacent to said seating area and an inclined area disposed outwardly of said work area which extends along an outer edge section of said work surface, said inclined section being inclined at an obtuse angle relative to said work area; and a tiered article support section which includes an upper frame supported adjacent to said work surface and an article support panel supported on said upper frame a vertically spaced distance above said work surface, said article support panel being vertically enlarged and including a lower tier which projects vertically and is outwardly inclined, and an upper tier that is supported on said lower tier and defines a shelf for supporting articles thereon, said shelf including a bottom wall that extends outwardly away from said lower tier and a back wall that extends upwardly from said bottom wall, said back wall being horizontally offset outwardly relative to said lower tier, said upper frame projecting upwardly above said work surface, said upper and lower tiers being supported on said upper frame, said article support panel being connected to said upper frame, said panel defining said upper and lower tiers which are formed integrally together as a one-piece unit, said panel being formed of a markable resin material, said lower tier and said back wall of said shelf having markable surfaces which face inwardly towards said open rear seating area.

7. A work station according to claim 4, wherein said article support section includes a panel which defines said upper and lower tiers, at least a portion of said panel being disposed directly above said outer edge section of said work surface in vertically spaced relation therewith.

8. A work station according to claim 6, which includes first and second said article support sections which are disposed vertically above said respective side sections of said work surface.

9. A work station according to claim 8, wherein said first and second article support sections are horizontally elongate so as to extend generally along outer edges of said work surface on the opposite sides thereof, said first and second article support sections extending longitudinally toward adjacent end sections thereof which are disposed in laterally spaced relation relative to each other to define an intermediate space therebetween.

10. A work station according to claim 6, wherein at least a portion of said panel is disposed directly above said outer edge section of said work surface in vertically spaced relation therewith.

11. A work station comprising:

a support frame;

a horizontally enlarged, U-shaped work surface mounted to said support frame, said U-shaped work surface having forwardly-extending opposite side sections and a sidewardly-extending intermediate section joining said side sections, said intermediate and side sections defining an open rear seating area therebetween, said work surface being sectioned into a substantially horizontal planar work area extending along an inward section of said work surface adjacent said seating area and a document storage area extending along an outward section of said work surface, said document storage area being inclined at an obtuse angle relative to said work area for supporting documents in an inclined position relative to said work area; and a tiered article support section which includes an upper frame supported adjacent said work surface and an article support panel supported on said upper frame a vertically spaced distance above said outward section of said work surface, said article support panel being vertically enlarged and being divided into lower and upper tiers, said lower tier projecting vertically and being outwardly inclined substantially above said outward portion of said work surface, said upper tier being supported on said lower tier and defining a shelf for supporting articles thereon, said shelf including a bottom wall extending outwardly from said lower tier and a back wall extending upwardly from said bottom wall, said back wall being horizontally offset outwardly relative to said lower tier, said article support section being positioned only above said outward section and outwardly of said work surface so that said work area is vertically uncovered by said article support section.

12. The work station according to claim 11, wherein said document storage area is U-shaped and extends across said intermediate section, ends of said document storage area extend a limited distance into said side sections so that said work area extends from a front to rear edge of said side sections along a portion thereof.

13. The work station according to claim 12, wherein first and second said article support sections are disposed vertically above respective said side sections of said work surface.

14. The work station according to claim 13, wherein one end of said upper frame is connected under said work surface and a second end of said upper frame is connected beneath said first and second article support sections.

15. The work station according to claim 14, wherein said first and second article support sections extending along respective said side sections are spaced apart above said intermediate section of said U-shaped work surface between said side sections, and a monitor support is positioned between said first and second article support sections and is connected to said work surface.

* * * * *